US005163866A

United States Patent [19]

Rasmussen

[11] Patent Number: 5,163,866

[45] Date of Patent: Nov. 17, 1992

[54] DISC-TYPE COIN SORTER WITH MULTIPLE-PATH QUEUING

[75] Inventor: James M. Rasmussen, Chicago, Ill.

[73] Assignee: Cummins-Allison Corp., Mt. Prospect, Ill.

[21] Appl. No.: 693,922

[22] Filed: Apr. 29, 1991

[51] Int. Cl.[5] ..... G07D 3/00

[52] U.S. Cl. ..... 453/10

[58] Field of Search ..... 453/6, 10, 32

[56] References Cited

U.S. PATENT DOCUMENTS

| | | | |
|---|---|---|---|
| 4,086,928 | 5/1978 | Ristvedt . | |
| 4,098,280 | 6/1978 | Ristvedt . | |
| 4,506,685 | 3/1985 | Childers et al. . | |
| 4,543,969 | 10/1985 | Rasmussen | 453/10 |
| 4,549,561 | 10/1985 | Johnson et al. | 453/10 |
| 4,557,282 | 12/1985 | Childers et al. . | |
| 4,564,036 | 1/1986 | Ristvedt . | |
| 4,564,037 | 1/1986 | Childers et al. . | |
| 4,570,655 | 2/1986 | Raterman | 453/32 X |
| 4,607,649 | 8/1986 | Taiple et al. . | |
| 4,681,128 | 7/1987 | Ristvedt et al. . | |
| 4,731,043 | 3/1988 | Ristvedt | 453/6 |
| 4,775,353 | 10/1988 | Childers et al. . | |
| 4,775,354 | 10/1988 | Rasmussen | 453/10 |
| 4,863,414 | 9/1989 | Ristvedt et al. . | |
| 4,921,463 | 5/1990 | Primdahl et al. . | |
| 4,966,570 | 10/1990 | Ristvedt et al. | 453/6 |
| 5,009,627 | 4/1991 | Rasmussen | 453/10 |
| 5,011,455 | 4/1991 | Rasmussen | 453/32 X |
| 5,026,320 | 6/1991 | Rasmussen . | |

*Primary Examiner*—F. J. Bartuska

*Attorney, Agent, or Firm*—Arnold, White & Durkee

[57] ABSTRACT

A coin sorter having a rotatable disc, a drive motor for rotating the disc, a stationary sorting head having a lower surface parallel to the upper surface of the rotatable disc and spaced slightly therefrom, the lower surface of the sorting head forming a channel for receiving coins passing beneath the inner edge of the sorting head and guiding those coins as the coins are carried along the lower surface of the sorting head by the rotating disc. The channel has an inner wall which extends outwardly away from the center of rotation of the disc, and then returns inwardly toward the center of rotation for a short distance before terminating, an outer wall which is substantially parallel to the inner wall, and a middle wall between the inner and outer walls. The middle wall extends inwardly from the outer wall along at least a major portion of the outer wall which extends outwardly from the center of rotation of the disc, and then merges with that portion of the outer wall which returns inwardly toward the center of rotation.

11 Claims, 14 Drawing Sheets 8
30
8
7
33
32
7
6
Rg
23
6
31
5
22
23a
5
4
4

14
30
13
14
33
13
12
12
23
31
32
11
22
23a
10
11
10

20
30
20
33
19
23
19
32
31
18
22
17
23a
16
18
C17
17
C16
16

26
30
25
26
25
32
24
C24
24
31
23
33
23
22
23a
21
23
21
Rg 32
30
31
32
31
33
30
Rg
C30
30
32
23
31
29
22
29
23a
28
28

38
30
37
38
32
37
36
31
C36
36
23
33
35
22
23a
34
35
34

DISC-TYPE COIN SORTER WITH MULTIPLE-PATH QUEUING

FIELD OF THE INVENTION

The present invention relates generally to coin sorting devices and, more particularly, to coin sorters of the type which use a resilient disc rotating beneath a stationary sorting head for sorting coins of mixed denominations.

SUMMARY OF THE INVENTION

It is a primary object of the present invention to provide an improved coin sorter which is capable of processing a wide variety of different coin sizes, e.g., the coin sets of different countries, without any significant changes in accuracy of throughput rate.

Another related object of the invention is to provide such an improved coin sorter which facilitates the alignment of coins of mixed denominations in a single layer and in single file.

It is another important object of this invention to provide an improved coin sorter which increases the throughput rate of coins processed by the sorter.

A further object of this invention is to provide an improved coin sorter which improves the separation of coins which are stacked on or overlap each other.

Other objects and advantages of the invention will be apparent from the following detailed description and the accompanying drawings.

In accordance with the present invention, the foregoing objectives are realized by providing a coin sorter comprising a rotatable disc, means for rotating the disc, a stationary sorting head having a lower surface parallel to the upper surface of the rotatable disc and spaced slightly therefrom, the lower surface of the sorting head forming a channel for receiving coins passing beneath the inner edge of the sorting head and guiding those coins as the coins are carried along the lower surface of the sorting head by the rotating disc, the channel having an inner wall which extends outwardly away from the center of rotation of the disc, and then returns inwardly toward the center of rotation for a short distance before terminating, an outer wall which is substantially parallel to the inner wall, and a middle wall between the inner and outer walls, the middle wall extending inwardly from the outer wall along at least a major portion of the outer wall which extends outwardly from the center of rotation of the disc, and then merges with that portion of the outer wall which returns inwardly toward the center of rotation.

DESCRIPTION OF THE PREFERRED EMBODIMENTS

Figure 1:
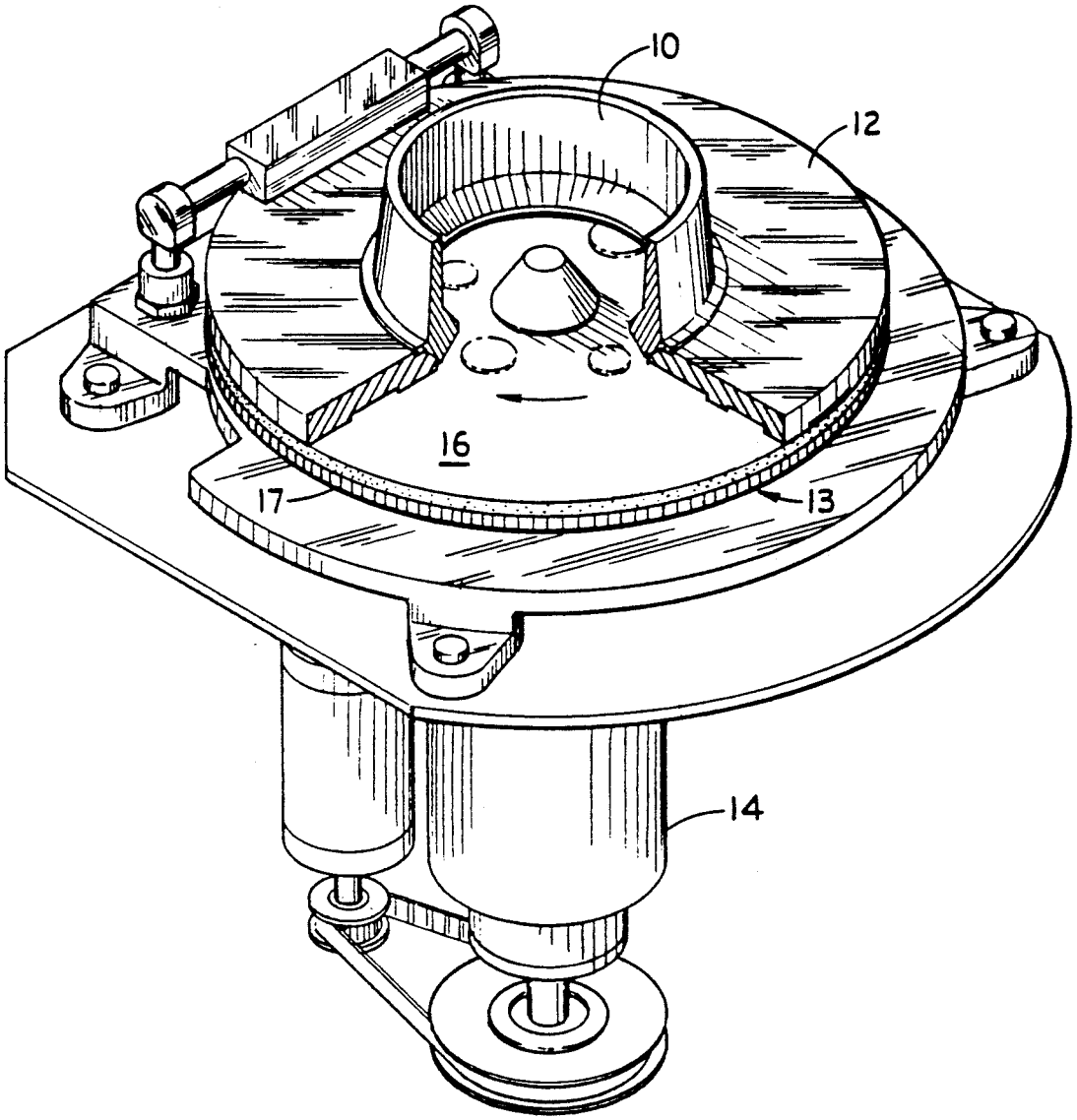
FIG. 1 is perspective view of a coin sorter embodying the present invention, with portions thereof broken away to show the internal structure.

While the invention is susceptible to various modifications and alternative forms, a specific embodiment thereof has been shown by way of example in the drawings and will be described in detail. It should be understood, however, that it is not intended to limit the invention to the particular form described, but, on the contrary, the invention is to cover all modifications, equivalents, and alternatives falling within the spirit and scope of the invention as defined by the appended claims.

Turning now to the drawings and referring first to FIG. 1, a hopper 10 receives coins of mixed denominations and feeds them through a central feed aperture in an annular sorting head or guide plate 12. As the coins pass through the feed aperture, they are deposited on the top surface of a rotatable disc 13. This disc 13 is mounted for rotation on a stub shaft (not shown) and driven by an electric motor 14. The disc 13 comprises a resilient pad 16, preferably made of a resilient rubber or polymeric material, bonded to the top surface of a solid metal disc 17.

As the disc 13 is rotated, the coins deposited on the top surface thereof tend to slide outwardly over the surface of the pad 16 due to centrifugal force. As the coins move outwardly, those coins which are lying flat on the pad 16 enter the gap between the pad surface and the sorting head 12 because the underside of the inner periphery of the sorting head is spaced above the pad 16 by a distance which is about the same as the thickness of the thickest coin.

Figure 2:
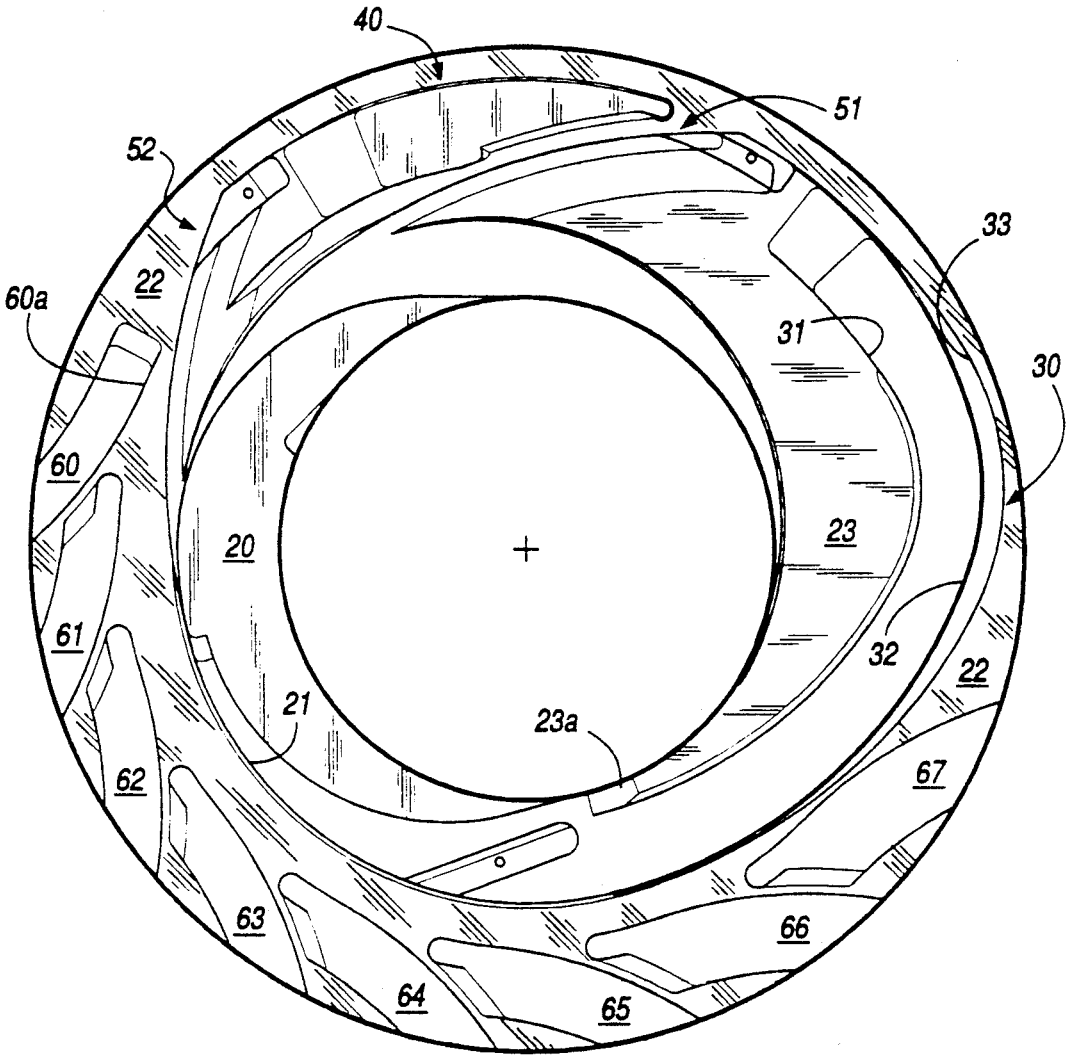
FIG. 2 is an enlarged horizontal section taken generally along the line 2—2 in FIG. 1 to show the configuration of the underside of the sorting head or guide plate.
Figure 3:
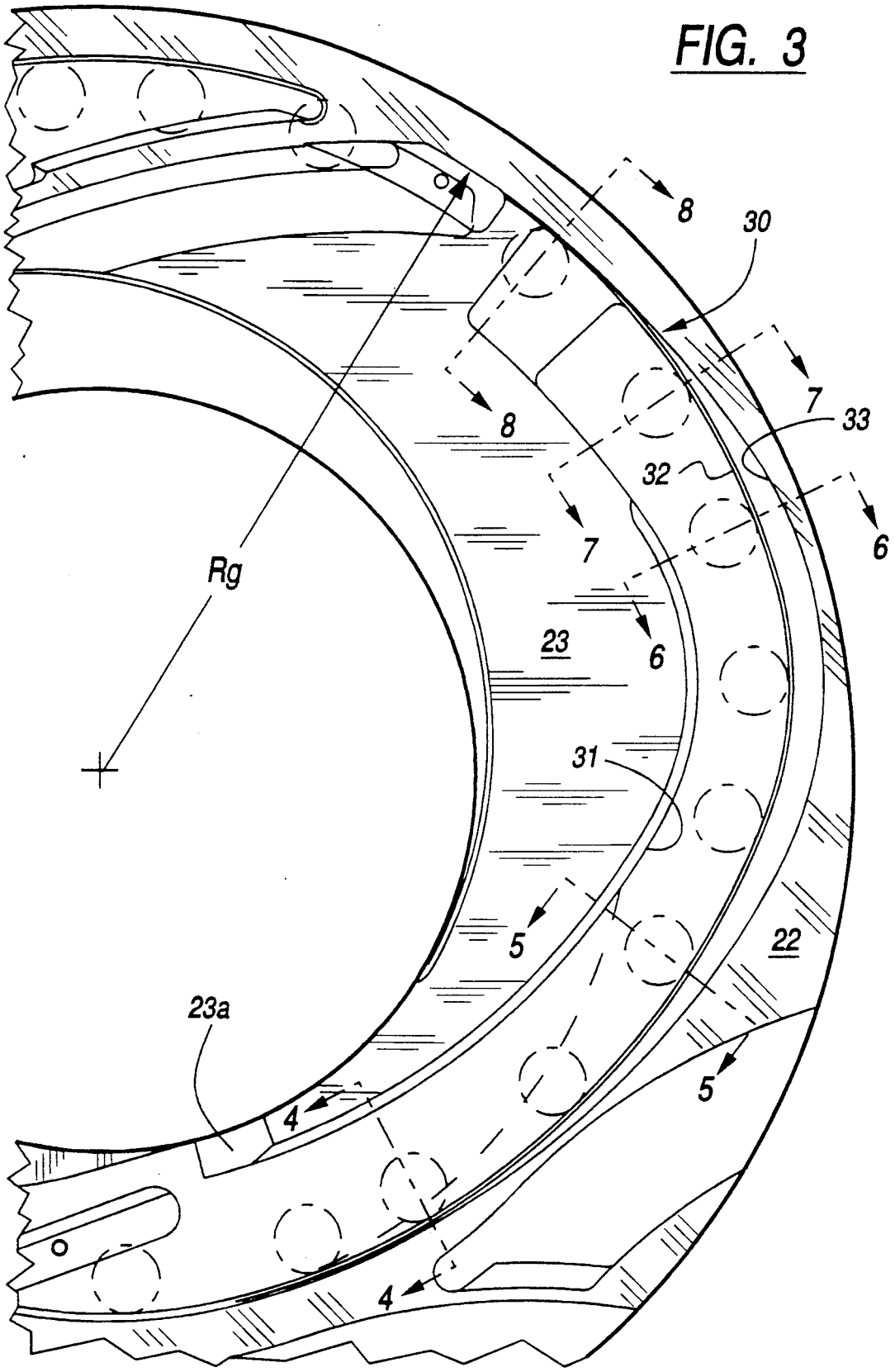
FIG. 3 is an enlarged view of the right-hand portion of FIG. 2, with various coins superimposed thereon.
Figure 4:
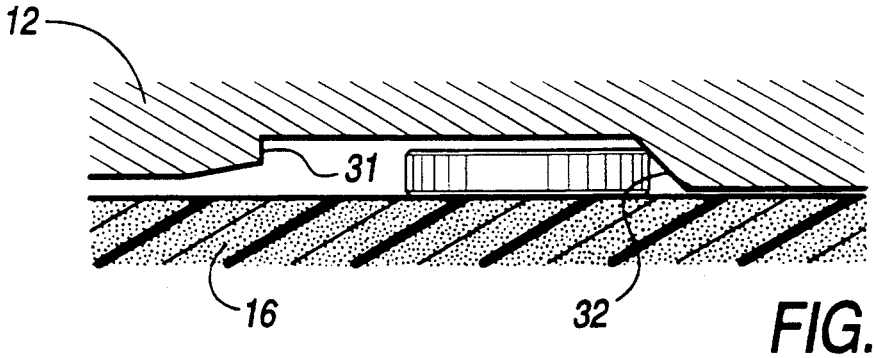
FIG. 4 is an enlarged section taken generally along line 4—4 in FIG. 2, showing the coins in full elevation.
Figure 5:
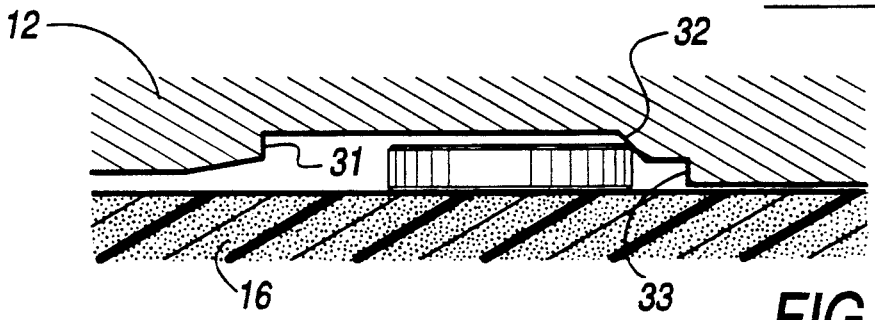
FIG. 5 is an enlarged section taken generally along line 5—5 in FIG. 2, showing the coins in full elevation.
Figure 6:
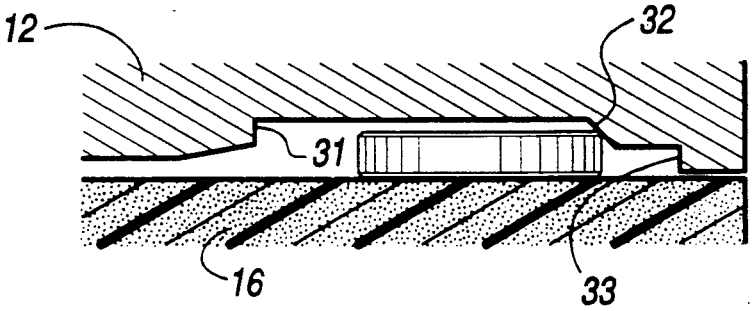
FIG. 6 is an enlarged section taken generally along line 6—6 in FIG. 2, showing the coins in full elevation.
Figure 7:
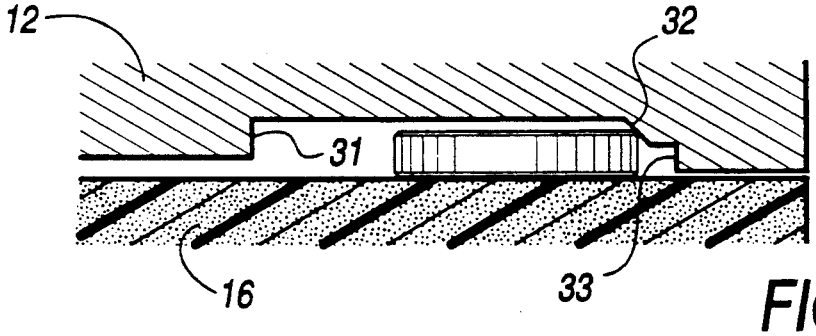
FIG. 7 is an enlarged section taken generally along line 7—7 in FIG. 2, showing the coins in full elevation.
Figure 8:
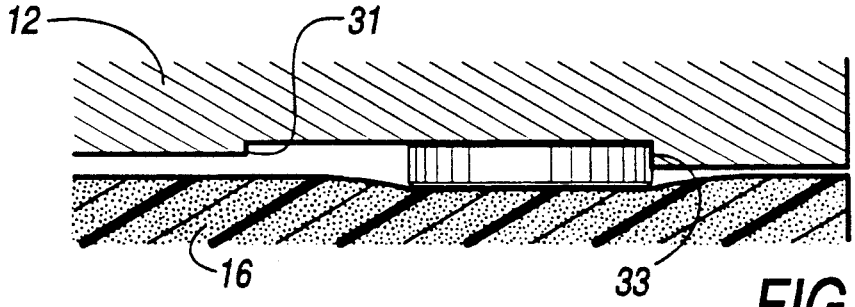
FIG. 8 is an enlarged section taken generally along line 8—8 in FIG. 2, showing the coins in full elevation.
Figure 9:
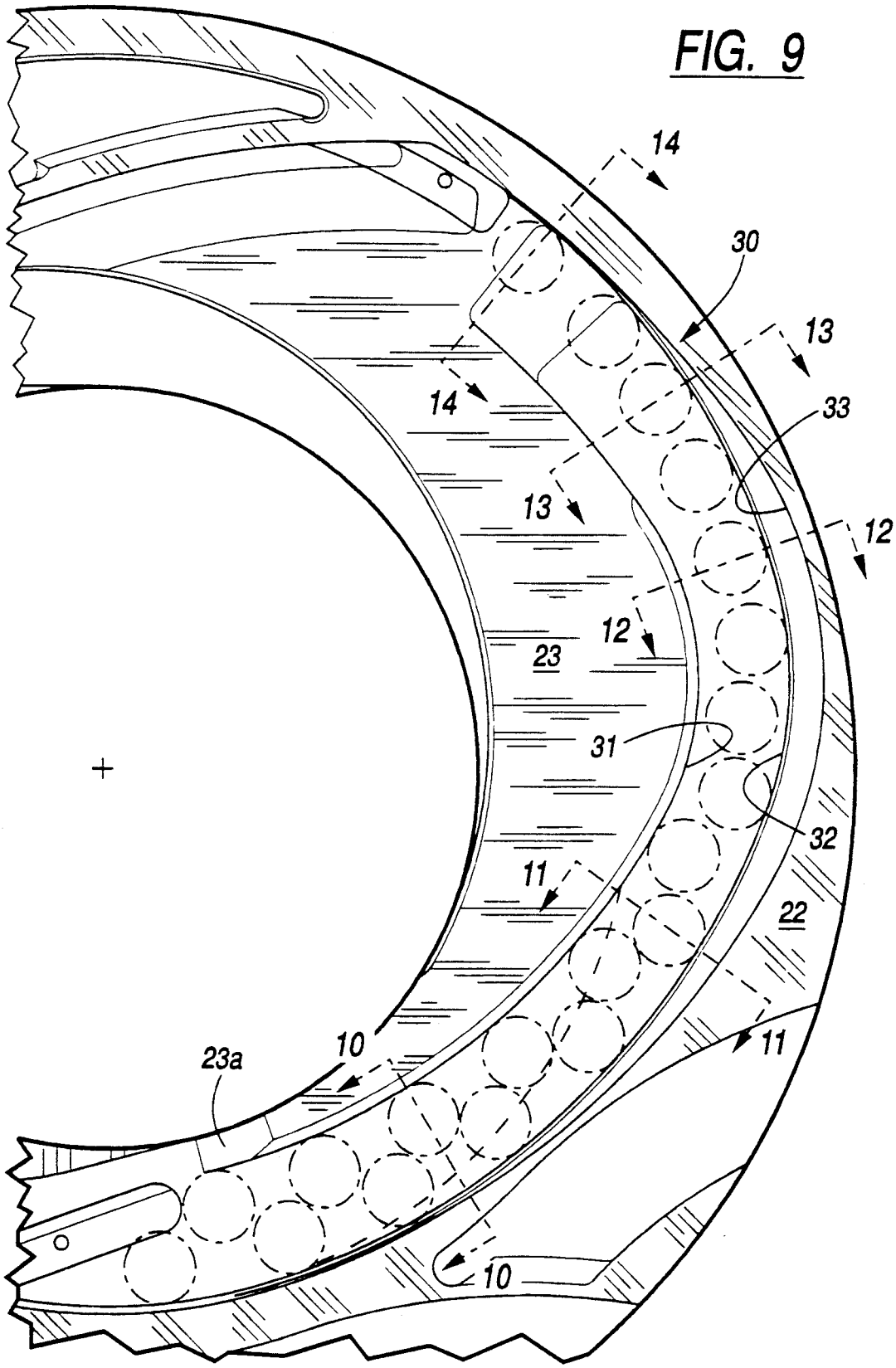
FIG. 9 is an enlarged view of the right-hand portion of FIG. 2, with various coins superimposed thereon.
Figure 10:
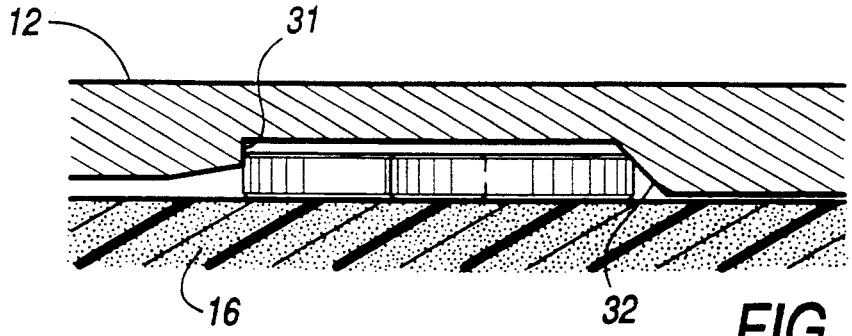
FIG. 10 is an enlarged section taken generally along line 10—10 in FIG. 2, showing the coins in full elevation.
Figure 11:
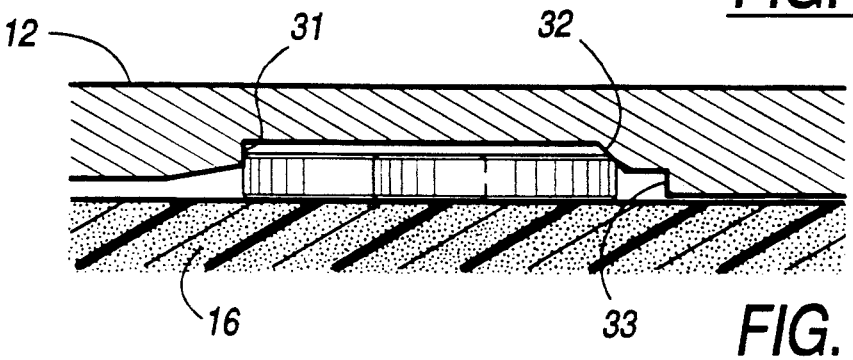
FIG. 11 is an enlarged section taken generally along line 11—11 in FIG. 2, showing the coins in full elevation.
Figure 12:
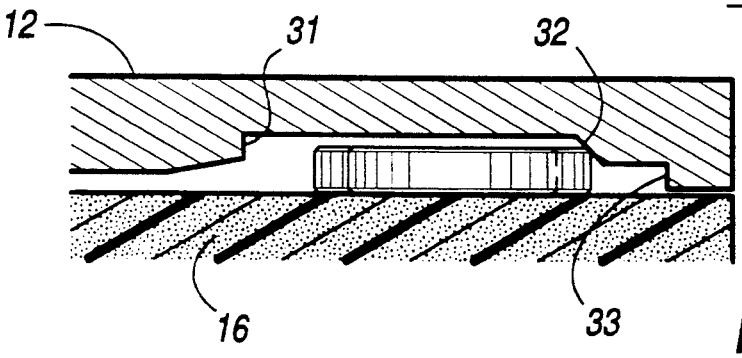
FIG. 12 is an enlarged section taken generally along line 12—12 in FIG. 2, showing the coins in full elevation.
Figure 13:
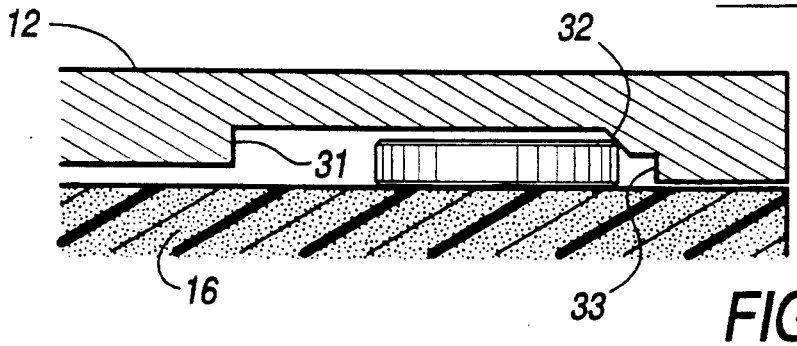
FIG. 13 is an enlarged section taken generally along line 13—13 in FIG. 2, showing the coins in full elevation.
Figure 14:
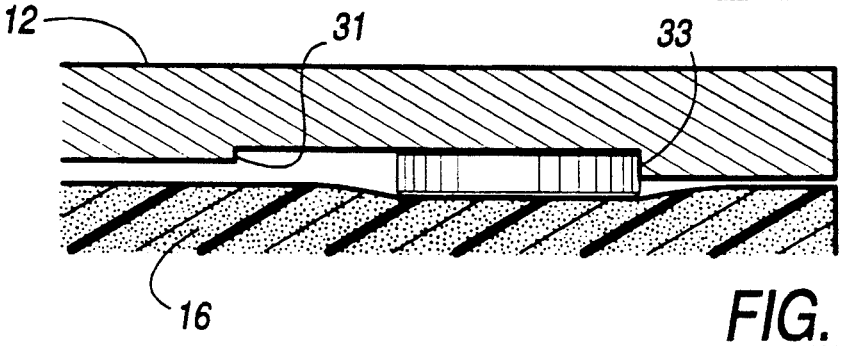
FIG. 14 is an enlarged section taken generally along line 14—14 in FIG. 2, showing the coins in full elevation.

As can be seen most clearly in FIG. 2, the outwardly moving coins initially enter an annular recess 20 formed in the underside of the sorting head 12 and extending around a major portion of the inner periphery of the sorting head. The outer wall 21 of the recess 20 extends downwardly to the lowermost surface 22 of the sorting head, which is preferably spaced from the top surface of the pad 16 by a distance e.g., 0.010 inch, which is slightly less, e.g., 0.010 inch, than the thickness of the thinnest coin. Consequently, the initial radial movement of the coins is terminated when they engage the wall 21 of the recess 20, though the coins continue to move circumferentially along the wall 21 by the rotational movement of the pad 16. Overlapping coins which only partially enter the recess 20 are stripped apart by a notch 20*a* formed in the top surface of the recess 20 along its inner edge (see FIG. 2).

The only portion of the central opening of the guide plate 12 which does not open directly into the recess 20 is that sector of the periphery which is occupied by a land 23 whose lower surface is at a slightly higher elevation than the lowermost surface 22 of the sorting head. The upstream end of the land 23 forms a ramp 23*a* (FIG. 2). When such a coin has only partially entered the recess 20, it engages the ramp 23*a* on the leading edge of the land 23. The ramp 23*a* presses the coin downwardly into the resilient pad 16, which causes the coin to be recirculated.

Coins which clear the ramp 23*a* enter a spiral channel 30 which guides the coins to a gaging channel 40. Recycling channels 51 and 52 are provided at the outlets of the channels 30 and 40, respectively, for recycling coins which do not have their outer edges close to the outer walls of the respective channels.

The spiral channel 30 causes coins of different thicknesses and/or diameters to follow different paths which facilitate the queuing of the coins and increase the coin throughout rate. Though following different paths, the coins of all denominations exit the spiral channel 30 with a common edge (the outer edges of all coins) aligned at the same or approximately the same radial position so that the opposite (inner) edges of the coins can be used for sorting.

The spiral channel 30 includes an inner channel region defined by an inner wall 31 and a middle wall 32, and an outer channel region defined by the middle wall 32 and an outer wall 33. The inner channel region is deeper than the outer channel region, and the middle wall 32 is tapered to enable coins to pass under that wall under certain conditions to be described below. Coins of different thicknesses and/or diameters follow different paths within one or both of the channel regions, and these different paths have been separately illustrated in FIGS. 3-8, 9-14, 15-20, 21-26, 27-32 and 33-38.

Referring first to FIGS. 3-8, these figures illustrate the path followed by small, thin coins in a single layer. These are coins having a diameter smaller than the width of the channel region between the inner wall 31 and the middle wall 32 of the channel, and thin enough to avoid being pressed into the resilient pad. Such coins are guided through the channel by the middle wall 32, exiting with their outer edges at the desired gaging radius $R_g$. Because the outer region of the channel, between the middle wall 32 and the outer wall 33, is spaced from the resilient pad by a distance that is less than the thickness of the thinnest coin, the only coins that pass outwardly over the middle wall 32 are those that are wider than the radial distance between the inner and middle walls; such coins are forced over the middle wall 32 by the inner wall 31 of the channel. Coins guided by either the middle wall 32 or the outer wall 33 have their outer edges aligned at the same gaging radius $R_g$ because the middle and outer walls merge at the end of the spiral channel 30.

The dual spiral channel 30 is particularly useful in queuing small coins which enter the channel in staggered relationship, as illustrated in FIGS. 9-14, for example. As such coins are advanced along the spiral channel 30 by the rotating disc, the spacing between any pair of successive coins gradually increases due to the increasing radius of the coin path. At the same time, coins guided by the inner wall 31 move ahead of coins guided by the middle wall 32, because the radius of the inner wall 31 increases at a faster rate than that of the middle wall 32. Moreover, the distance between the inner and middle walls 31 and 32 is progressively decreased. The effect of all these variables is to gradually bring coins which are staggered at the inlet end of the channel 30 into single file by the time they reach the point where the distance between the inner and middle walls 31 and 32 at its minimum. This alignment of the coins into a single file is achieved progressively along the length of the spiral channel, so that the coins move smoothly and continuously through the channel at high throughput rates.

Figure 15:
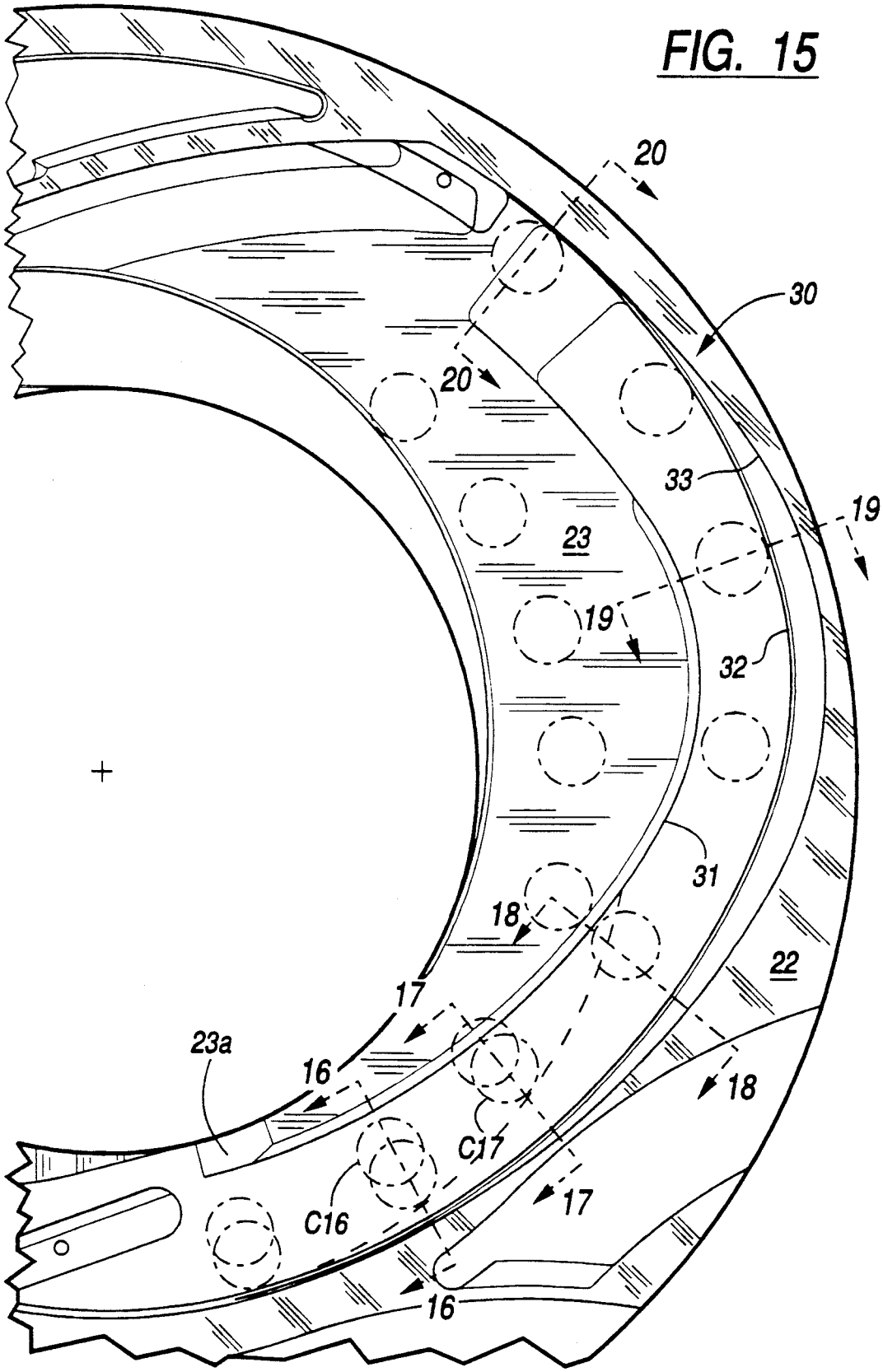
FIG. 15 is an enlarged view of the right-hand portion of FIG. 2, with various coins superimposed thereon.
Figure 16:
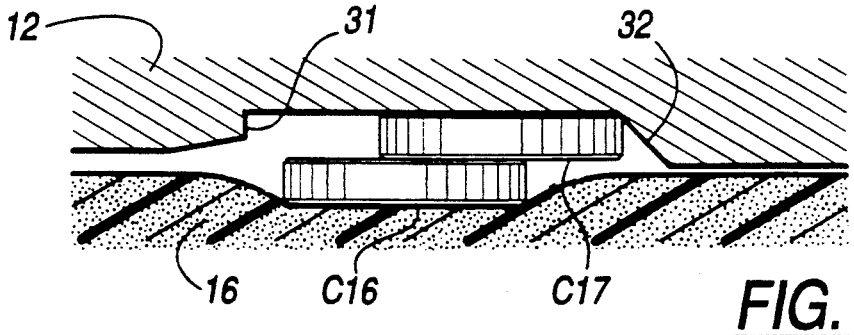
FIG. 16 is an enlarged section taken generally along line 16—16 in FIG. 2, showing the coins in full elevation.
Figure 17:
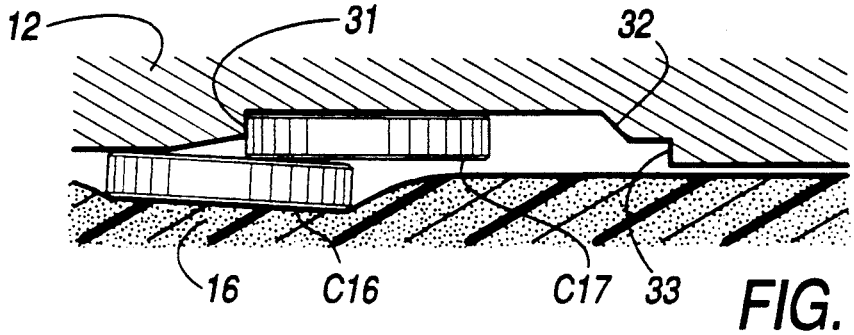
FIG. 17 is an enlarged section taken generally along line 17—17 in FIG. 2, showing the coins in full elevation.
Figure 18:
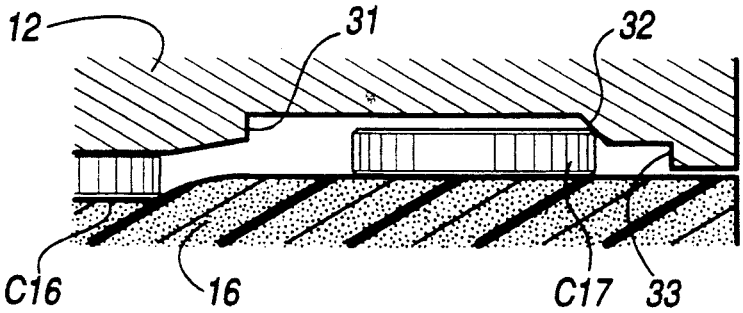
FIG. 18 is an enlarged section taken generally along line 18—18 in FIG. 2, showing the coins in full elevation.
Figure 19:
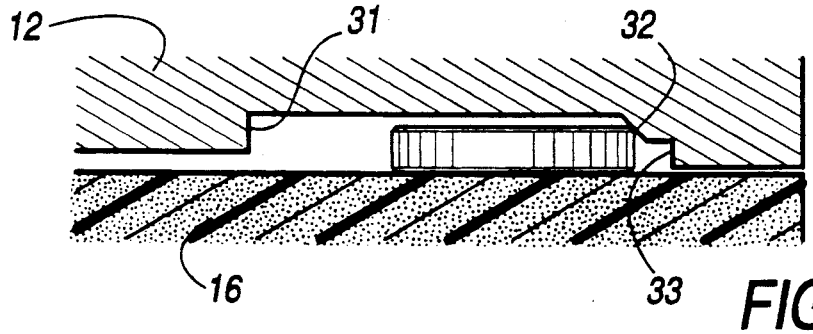
FIG. 19 is an enlarged section taken generally along line 19—19 in FIG. 2, showing the coins in full elevation.
Figure 20:
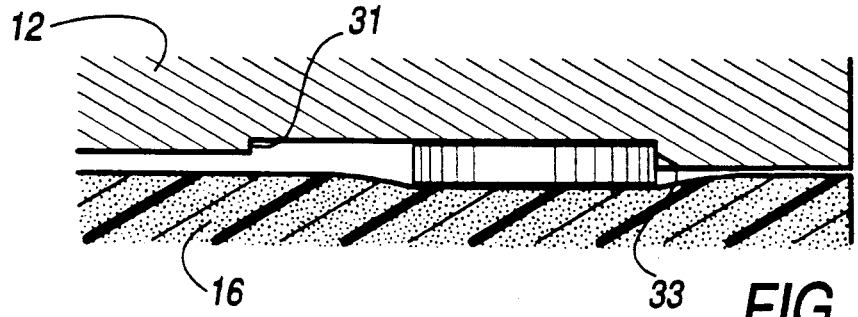
FIG. 20 is an enlarged section taken generally along line 20—20 in FIG. 2, showing the coins in full elevation.

The illustrative spiral channel 30 also strips apart stacked or shingled coins, as illustrated in FIGS. 15–20. In general, the combined thickness of a pair of stacked or shingled coin is great enough to cause the lower coin in that pair to be pressed into the resilient pad. Consequently, that pair of coins will be rotated concentrically with the disc, as illustrated by the coin pairs C16, and C17 in FIGS. 15–17. Because the inner wall 31 spirals outwardly, the upper coin will eventually engage the upper vertical portion of the inner wall 31, as illustrated in FIG. 17, and the lower coin will engage the tapered lower portion of the inner wall, as also illustrated in FIG. 17, and pass under that wall (see FIG. 18). As shown in FIG. 15, the latter coin will be recirculated back to the entry region of the sorting head and will later re-enter the spiral channel.

Small, thick coins follow the path illustrated in FIGS. 21–26. These coins have a diameter small enough to enable them to enter and remain between the middle and outer walls 31 and 32 throughout the entire length of the spiral channel 30. The thickness of these coins, however, is greater than the distance between the channel ceiling and the resilient pad, as a result of which the coins are pressed into the resilient pad (see FIG. 22). Consequently, these coins are not free to follow the middle wall 32 as it spirals outwardly, but rather move concentrically with the disc until they engage the inner wall 31 (see FIGS. 22 and 23). They are then guided by the inner wall 31 until they reach the position of coin C24, at which point the radius of the inner wall 31 begins to decrease.

Figure 21:
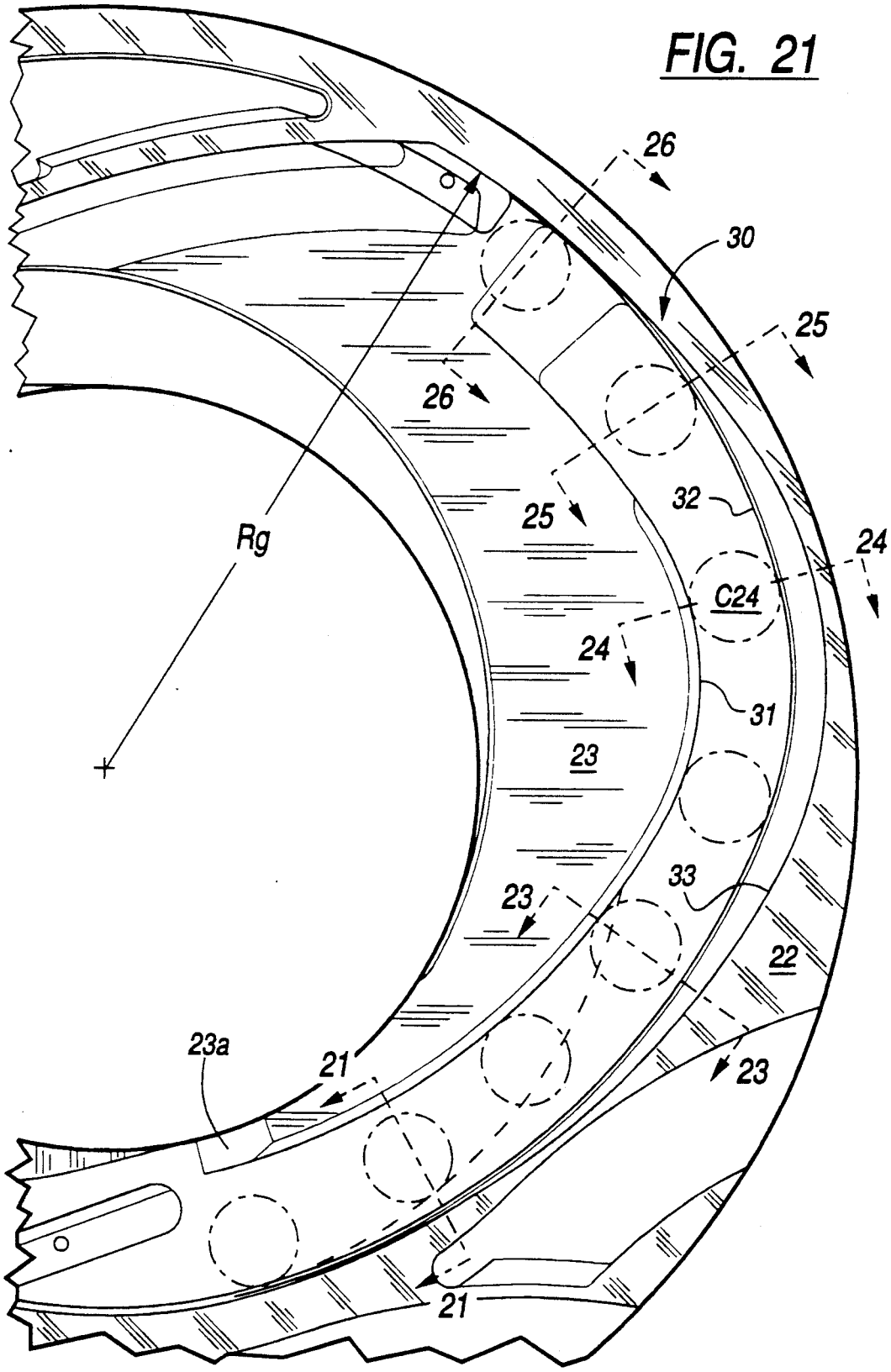
FIG. 21 is an enlarged view of the right-hand portion of FIG. 2, with various coins superimposed thereon.
Figure 22:
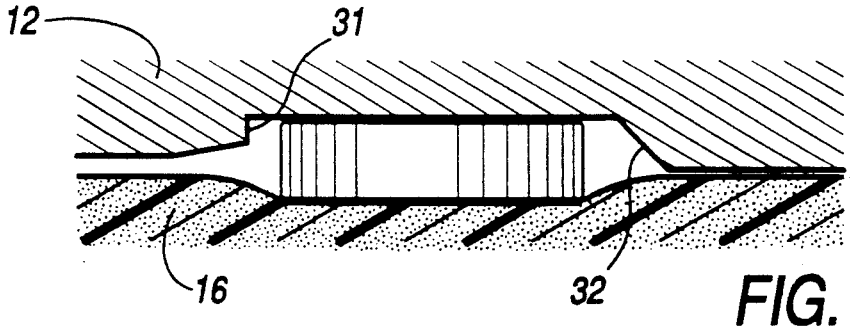
FIG. 22 is an enlarged section taken generally along line 22—22 in FIG. 2, showing the coins in full elevation.
Figure 23:
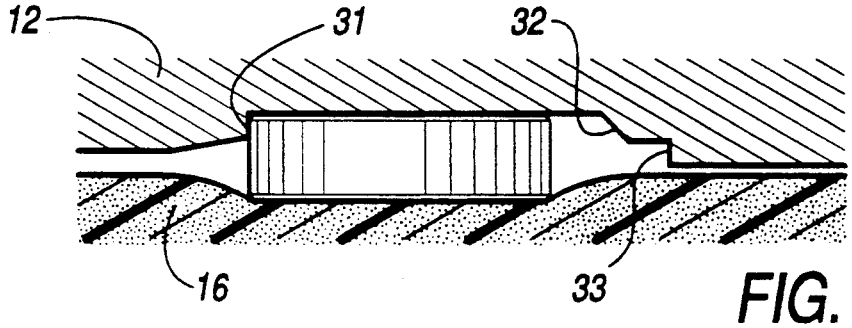
FIG. 23 is an enlarged section taken generally along line 23—23 in FIG. 2, showing the coins in full elevation.
Figure 24:
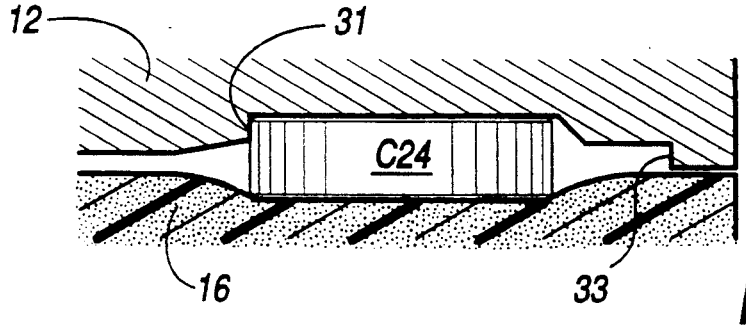
FIG. 24 is an enlarged section taken generally along line 24—24 in FIG. 2, showing the coins in full elevation.
Figure 25:
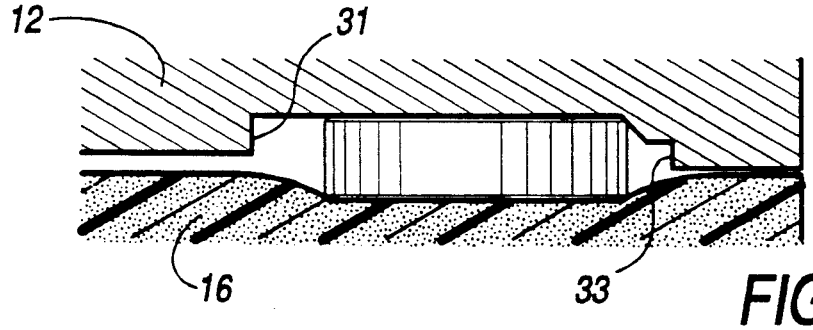
FIG. 25 is an enlarged section taken generally along line 25—25 in FIG. 2, showing the coins in full elevation.
Figure 26:
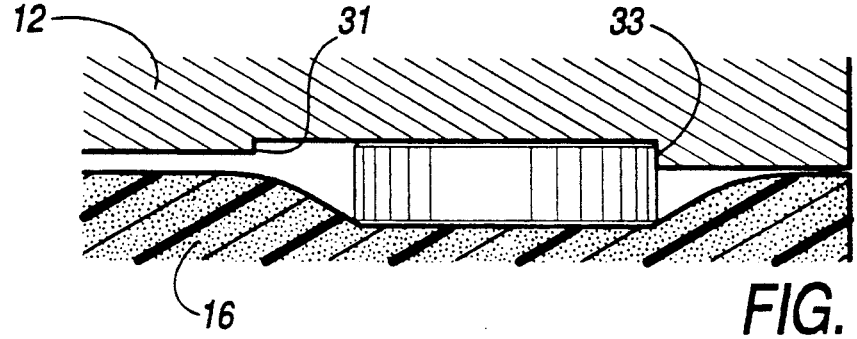
FIG. 26 is an enlarged section taken generally along line 26—26 in FIG. 2, showing the coins in full elevation.
Figure 27:
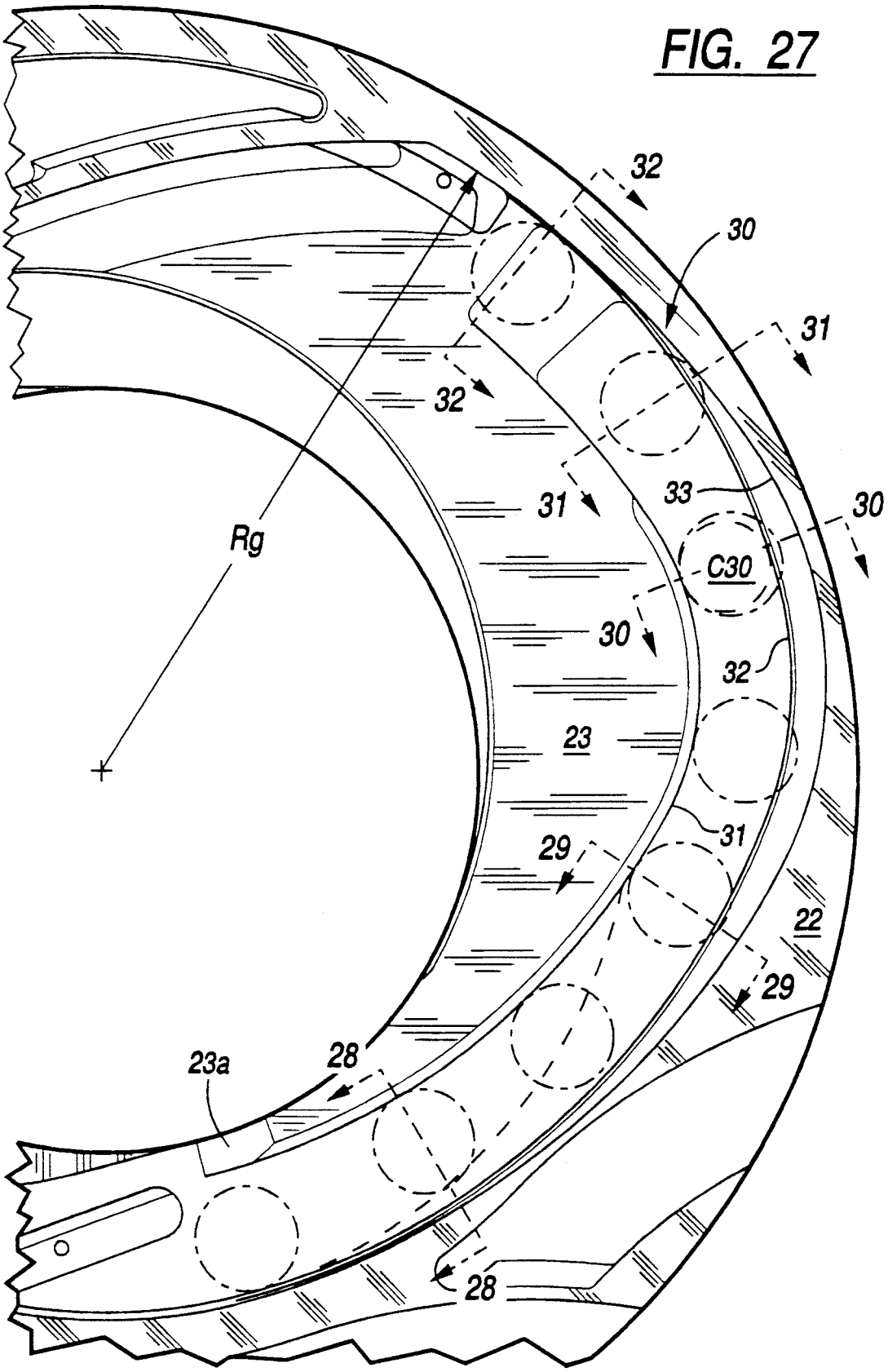
FIG. 27 is an enlarged view of the right-hand portion of FIG. 2, with various coins superimposed thereon.
Figure 28:
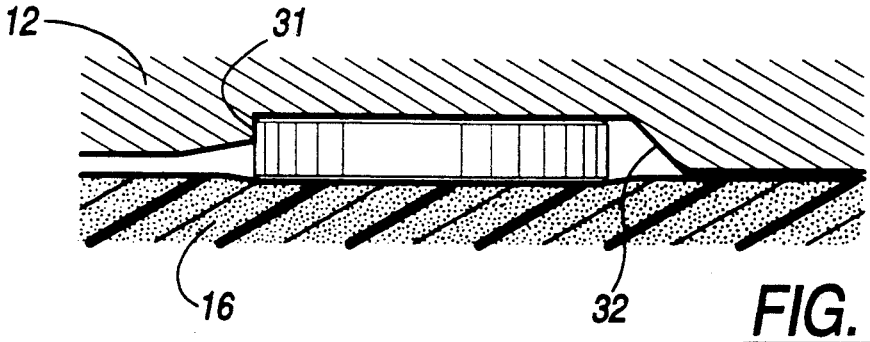
FIG. 28 is an enlarged section taken generally along line 28—28 in FIG. 2, showing the coins in full elevation.

As the inner wall 31 drops away from the advancing coin, the coin once again moves concentrically with the disc because the coin is still pressed into the resilient pad (see FIG. 25). The channel 30 is preferably designed so that the minimum distance between the inner and middle walls, i.e., at the location of coin C24 in FIG. 21, is about the same as the diameter of the smallest coin that is thick enough to be pressed into the resilient pad in the channel region between the inner and middle walls. Consequently, when such a coin reaches the point where that distance is a minimum, the outer edge of the coin is adjacent the middle wall, as shown in FIG. 24. The radius of the middle wall 32 remains constant at the desired gaging radius $R_g$ from that point to the end of the channel 30, and thus the small, thick coins exit the channel 30 with the outer edges of the coins at the gaging radius $R_g$.

Because the middle wall 32 is tapered (preferably at an angle of less than 45° from vertical), slight variations in the diameter of the small, thick coins merely cause the outer edges of such coins to be positioned at various elevations on that taper, or even slightly inwardly of the taper. At the outermost end of the channel 30, where the middle and outer walls merge, the wall engaging the outer edges of the coins becomes vertical at the innermost radius of the tapered portion of the middle wall. Thus, the outer edges of all the coins are ultimately aligned at the same gaging radius $R_g$.

Figure 29:
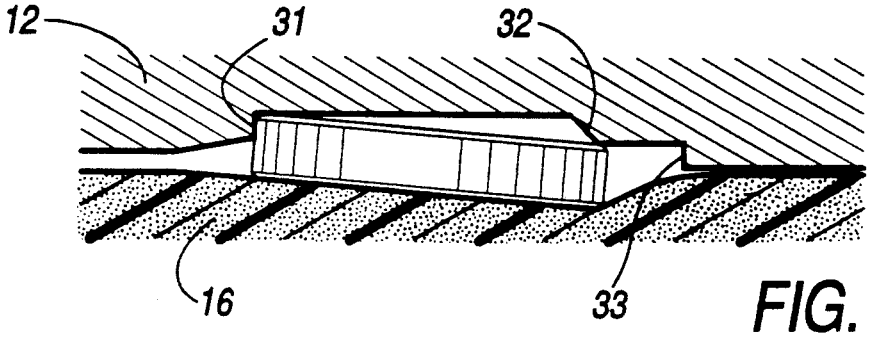
FIG. 29 is an enlarged section taken generally along line 29—29 in FIG. 2, showing the coins in full elevation.
Figure 30:
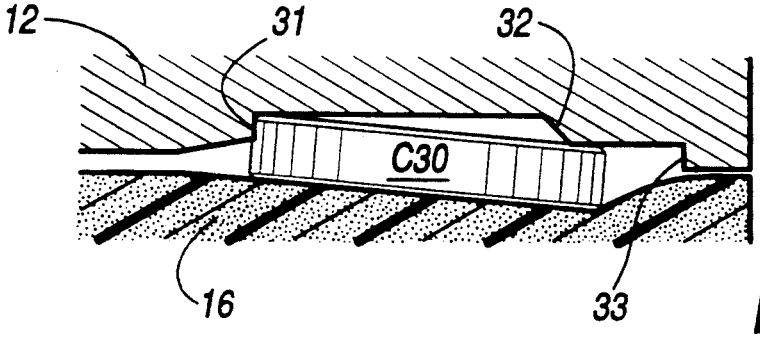
FIG. 30 is an enlarged section taken generally along line 30—30 in FIG. 2, showing the coins in full elevation.
Figure 31:
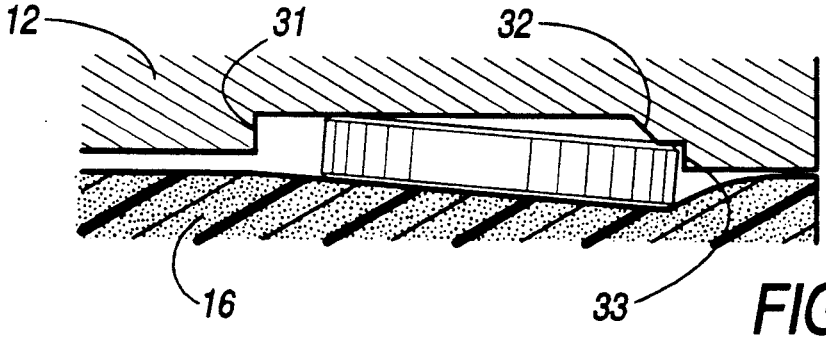
FIG. 31 is an enlarged section taken generally along line 31—31 in FIG. 2, showing the coins in full elevation.
Figure 32:
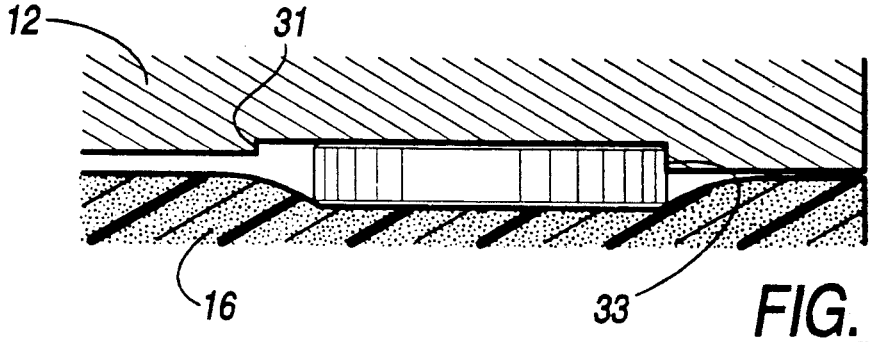
FIG. 32 is an enlarged section taken generally along line 32—32 in FIG. 2, showing the coins in full elevation.
Figure 33:
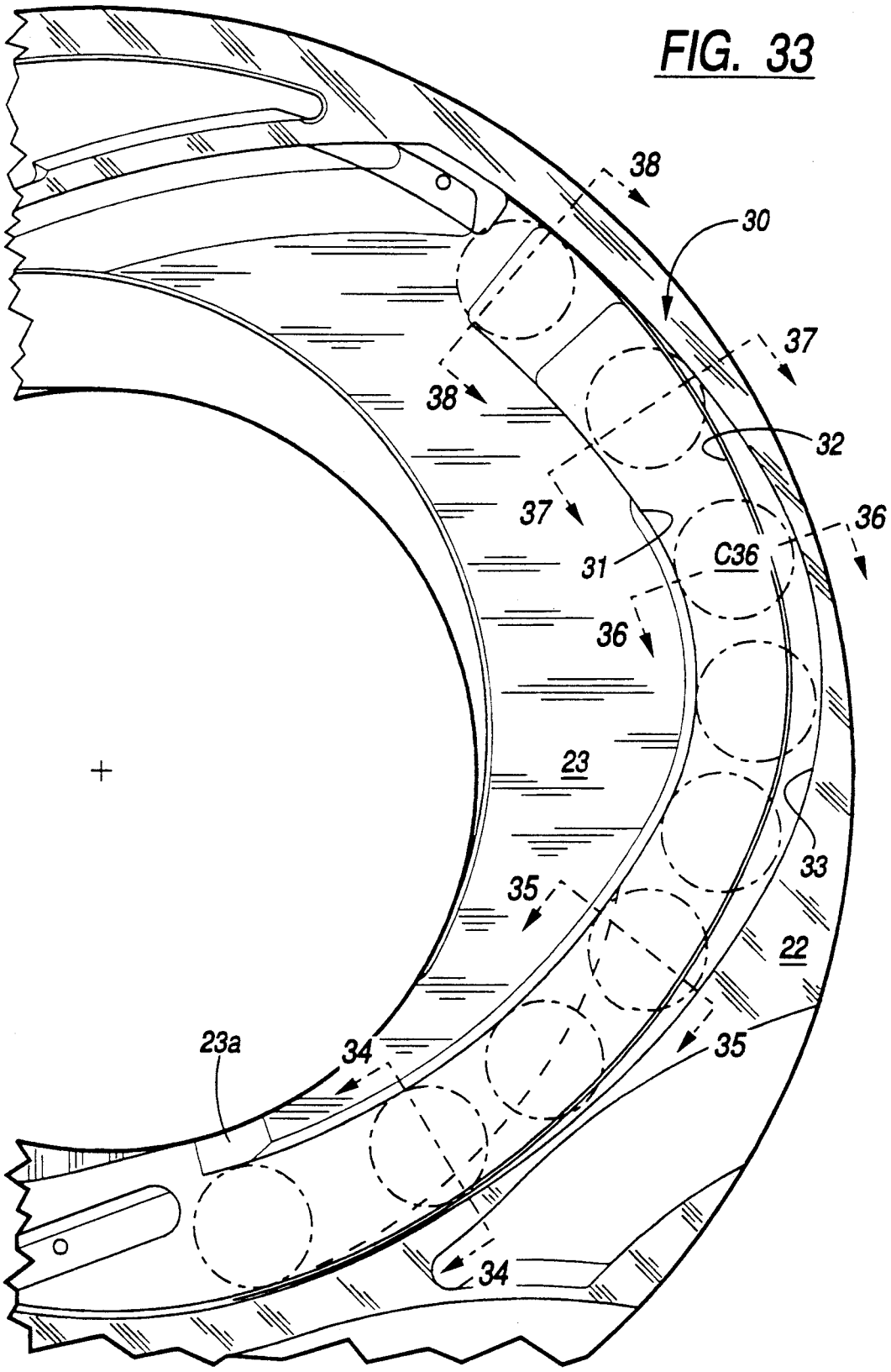
FIG. 33 is an enlarged view of the right-hand portion of FIG. 2, with various coins superimposed thereon.
Figure 34:
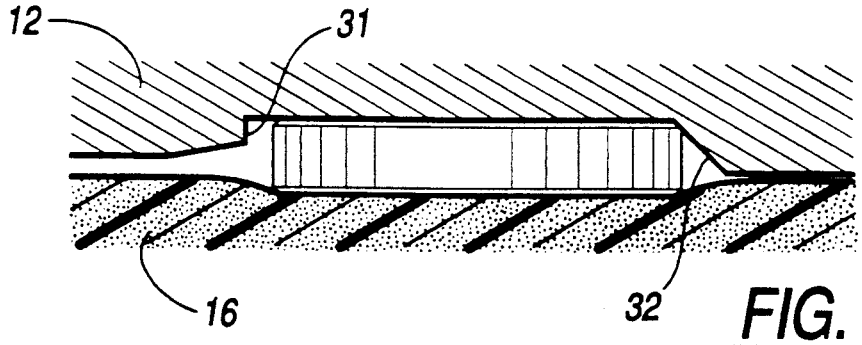
FIG. 34 is an enlarged section taken generally along line 34—34 in FIG. 2, showing the coins in full elevation.
Figure 35:
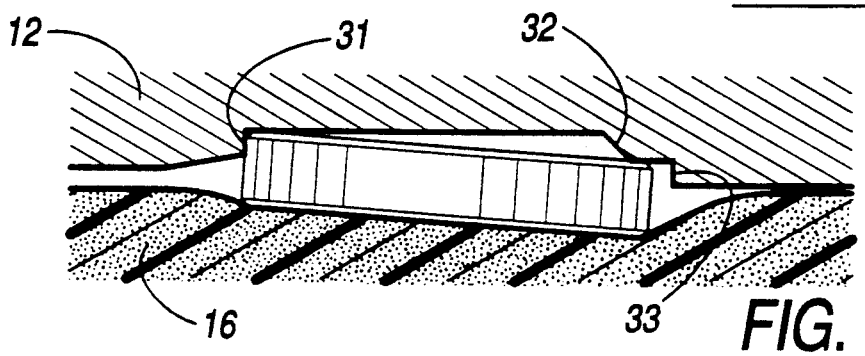
FIG. 35 is an enlarged section taken generally along line 35—35 in FIG. 2, showing the coins in full elevation.

Thick coins which have a diameter greater that the minimum distance between the inner and middle walls 31 and 32 follow the path shown in FIGS. 27–32. Because these coins are pressed into the resilient pad, they are rotated concentrically with the disc until they engage the inner wall 31 (see FIG. 28) and are then guided by that inner wall until they reach its maximum radius (coin C30). Because the radius of the inner wall 31 increases at a faster rate than that of the middle wall 32, these two walls gradually converge. As a result, the outer portion of a thick coin guided by the inner wall 32 gradually rides down and under the tapered middle wall 32, as illustrated in FIGS. 29 and 30.

As the inner wall 31 drops away from the inner edge of such a coin, the coin once again rotates concentrically with the disc until the outer edge of the coin engages the outer wall 33. Any coin which extends outwardly beyond the middle wall 32 will ultimately engage the outer wall 33 because the radius of the outer wall is progressively reduced toward the outlet end of the spiral channel 30 so that the outer wall finally merges with the constant radius portion of the middle wall. Consequently, these large thick coins also emerge from the spiral channel 30 with their outer edges aligned at the gaging radius $R_g$.

Figure 36:
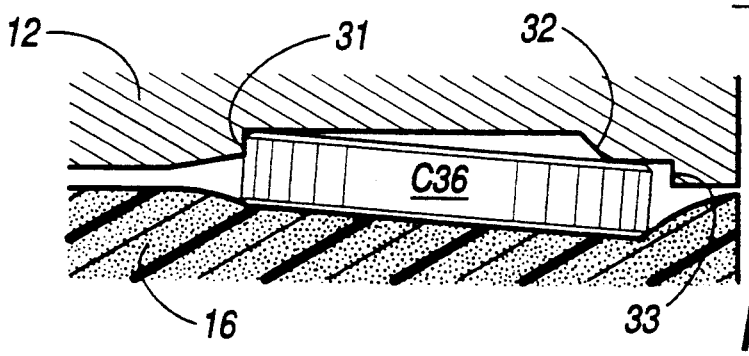
FIG. 36 is an enlarged section taken generally along line 36—36 in FIG. 2, showing the coins in full elevation.
Figure 37:
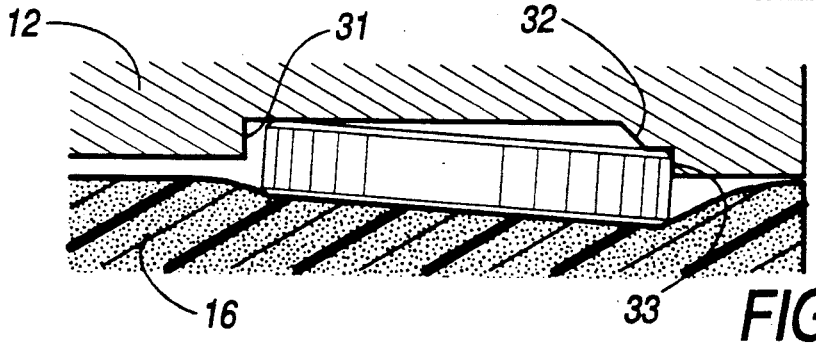
FIG. 37 is an enlarged section taken generally along line 37—37 in FIG. 2, showing the coins in full elevation.
Figure 38:
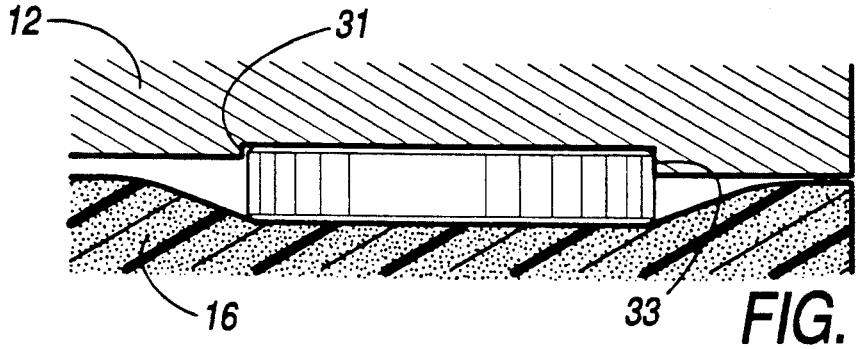
FIG. 38 is an enlarged section taken generally along line 38—38 in FIG. 2, showing the coins in full elevation.

Thin coins which have a diameter greater than the minimum distance between the inner and middle walls 31 and 32 follow the path shown in FIGS. 33–38. These coins are not pressed into the resilient pad in the relatively deep channel region between the inner and middle walls 31 and 32, and thus such coins move outwardly until they engage the middle wall 32. The coins follow that middle wall until the inner edges of the coins come into engagement with the inner wall 31, which gradually forces the outer portions of the coins under the tapered middle wall 32, as illustrated by coin C36 (FIG. 36). It can be seem that the effect will be the same for a thin coin of any diameter greater than the minum width between the inner and middle walls 31 and 32. As the inner wall 31 drops away from the inner edges of such coins, the outer edges of the coins ride upwardly over the tapered middle wall 32 and are then guided by the uppermost edge of the middle wall to the outlet of the spiral channel 30.

It can occur that correctly aligned coins passing under the recycling channel 51 can be slightly shifted in their radial position. To correct this, coins which pass the recycling channel 51 enter the gaging channel 40 which allows the coins to be realigned against the radially outer wall 41. The channel 40 and wall 41 allow the coins in the sorting path an opportunity to realign their outer edges at the radial position required for correct sorting.

Beyond the gaging channel 40, the sorting head 12 forms a series of exit channels 60, 61, 62, 63, 64, 65, 66 and 67 which function as selecting means to discharge coins of different denominations at different circumferential locations around the periphery of the sorting head. Thus, the channels 60–67 are spaced circumferentially around the outer periphery of the sorting head 12, with the innermost edges of successive channels located progressively farther away from the common radial location of the outer edges of all coins for receiving and ejecting coins in order of increasing diameter. In the particular embodiment illustrated, the eight channels 60–67 are positioned and dimensioned to successively eject the eight Australian coins, namely, the 1-cent coins (channel 60), 5-cent conis (channel 61), 2-dollar coins (channel 62), 2-cent coins (channel 63), 10-cent coins (channel 64), 1-dollar coins (channel 65), 20-cent coins (channel 66) and 50-cent coins (channel 67). The innermost edges of the exit channels 60–67 are positioned so that the inner edge of a coin of only one particular denomination can enter each channel; the coins of all other denominations reaching a given exit channel extend inwardly beyond the innermost edge of that particular channel so that those coins cannot enter the channel and, therefore, continue on to the next exit channel.

For example, the first exit channel 60 is intended to discharge only 1-cent coins, and thus the innermost edges 60*a* of this channel is located at a radius that is spaced inwardly from the radius of the gaging wall 41 by a distance that is only slightly greater than the diameter of a 1-cent coin. Consequently, only 1-cent coins can enter the channel 60. Because the outer edges of all denominations of coins are located at the same radial position when they leave the gaging channel 40, the inner edges of all denominations other than the 1-cent coin extend inwardly beyond the innermost edge 60*a* of the channel 60, thereby preventing these coins from entering that particular channel.

Of the coins that reach channel 61, the inner edges of only the 5-cent coins are located close enough to the outer periphery of the sorting head 12 to enter that exit channel. The inner edges of all other denominations extend inwardly beyond the innermost edge of the channel 61 so that they remain gripped between the sorting head and the resilient pad. Consequently, such coins are rotated past the channel 61 and continue on to the next exit channel.

Similarly, only 2-dollar coins can enter the channel 62, only 2-cent coins can enter the channel 63, only 10-cent coins can enter the channel 64, only 1-dollar coins can enter the channel 65, only 20-cent coins can enter the channel 66, and only 50-cent coins can enter the channel 67.

What is claimed is:

1. A coin sorter comprising a rotatable disc, means for rotating said disc, a stationary sorting head having a lower surface parallel to the upper surface of said rotatable disc and spaced slightly therefrom, the lower surface of said sorting head forming a channel for receiving coins passing beneath the inner edge of the sorting head and guiding those coins as the coins are carried along the lower surface of the sorting head by the rotating disc, said channel having an inner wall which extends outwardly away from the center of rotation of said disc, and then returns inwardly toward said center of rotation for a short distance before terminating, an outer wall which is substantially parallel to said inner wall, and a middle wall between said inner and outer walls, said middle wall extending inwardly from said outer wall along at least a major portion of that portion of the outer wall which extends outwardly from the center of rotation of said disc, and then merging with that portion of said outer wall which returns inwardly toward said center of rotation, the radius of said middle wall from said center of rotation increasing in the direction of coin movement, and then remaining constant to merge with the returning portion of said outer wall.

2. The coin sorter of claim 1 wherein said middle wall is beveled to allow coins to be forced under that wall.

3. The coin sorter of claim 1 wherein the ceiling of said channel inwardly of said middle wall is farther above the upper surface of said rotating disc than the ceiling of said channel outwardly of said middle wall.

4. The coin sorter of claim 1 wherein the height of said inner wall is less than the thickness of the thinnest coin.

5. The coin sorter of claim 1 wherein at least a portion of said middle wall is spaced from said inner wall by a distance that is less than twice the diameter of the smallest-diameter coin.

6. The coin sorter of claim 1 wherein the ceiling of said channel in the region between said outer and middle walls is spaced from the upper surface of said disc by a distance that is less than the thickness of the thinnest coin.

7. A coin sorter comprising a rotatable disc, means for rotating said disc, a stationary sorting head having a lower surface parallel to the upper surface of said rotatable disc and spaced slightly therefrom.

the lower surface of said sorting head forming a channel for receiving coins passing beneath the inner edge of the sorting head and guiding those coins as the coins are carried along the lower surface of the sorting head by the rotating disc, said channel having an inner wall which extends outwardly away from the center of rotation of said disc, and then returns inwardly toward said center of rotation for a short distance before terminating, an outer wall which is substantially parallel to said inner wall, and a middle wall between said inner and outer walls, said middle wall extending inwardly from said outer wall along at least a major portion of the outer wall which extends outwardly from the center of rotation of said disc, and then merges with that portion of said outer wall which returns inwardly toward said center of rotation, the radius of said middle wall from said center of rotation increasing in the direction of coin movement, and then remaining constant to merge with the returning portion of said outer wall.

8. A coin sorter comprising a rotatable disc, means for rotating said disc, a stationary sorting head having a lower surface parallel to the upper surface of said rotatable disc and spaced slightly therefrom, said sorting head forming a feed aperture for admitting coins between said sorting head and said disc, the lower surface of said sorting head forming a generally spiral channel having inner and outer walls for guiding coins radially outwardly away from the periphery of said feed aperture as the coins are carried along the lower surface of the sorting head by the rotating disc, said channel having a middle wall, between the inner and outer walls of the channel, with the channel region inwardly of said middle wall being deeper than the channel region outwardly of said middle wall, said inner and middle walls converging until said middle wall reaches its maximum radial distance from the center of rotation of said disc, and said outer and middle walls converging and ultimately merging after said middle wall reaches said maximum radial distance from said center of rotation.

9. The coin sorter of claim 8 wherein said inner and middle walls converge to a minimum radial spacing that is substantially equal to the diameter of the smallest-diameter coin having a thickness greater than the vertical distance between said disc and said deeper channel region.

10. A coin sorter comprising a rotatable disc, means for rotating said disc, a stationary sorting head having a lower surface parallel to the upper surface of said rotatable disc and spaced slightly therefrom, said sorting head forming a feed aperture for admitting coins between said sorting head and said disc, the lower surface of said sorting head forming a generally spiral channel having inner and outer walls for guiding coins radially outwardly away from the periphery of said feed aperture as the coins are carried along the lower surface of the sorting head by the rotating disc, said channel having a middle wall, between the inner and outer walls of the channel, with the channel region inwardly of said middle wall being deeper than the channel region outwardly of said middle wall, said inner and middle walls converging until said middle wall reaches its maximum radial distance from the center of rotation of said disc, and said outer and middle walls converging, and ultimately merging after said middle wall reaches said maximum radial distance from said center of rotation.

11. A coin sorter comprising a rotatable disc, means for rotating said disc, a stationary sorting head having a lower surface parallel to the upper surface of said rotatable disc and spaced slightly therefrom, said sorting head forming a feed aperture for admitting coins between said sorting head and said disc, the lower surface of said sorting head forming a generally spiral channel having inner and outer walls for guiding coins radially outwardly away from the periphery of said feed aperture as the coins are carried along the lower surface of the sorting head by the rotating disc, said channel having a middle wall, between the inner and outer walls of the channel, with the channel region inwardly of said middle wall being deeper than the channel region outwardly of said middle wall, said inner wall diverging from said middle wall after said middle wall reaches said maximum radial distance from said center of rotation.

* * * * *